US012800166B2

(12) United States Patent
McKinney

(10) Patent No.: US 12,800,166 B2
(45) Date of Patent: Nov. 17, 2026

(54) BYPASS VENTILATOR CORE

(71) Applicant: Carrier Corporation, Palm Beach Gardens, FL (US)

(72) Inventor: Peter Johannes McKinney, Boulder, CO (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 477 days.

(21) Appl. No.: 18/476,246

(22) Filed: Sep. 27, 2023

(65) Prior Publication Data

US 2024/0102675 A1 Mar. 28, 2024

Related U.S. Application Data

(60) Provisional application No. 63/377,404, filed on Sep. 28, 2022.

(51) Int. Cl.
*F24F 7/04* (2006.01)

(52) U.S. Cl.
CPC ..... *F24F 7/04* (2013.01)

(58) Field of Classification Search
CPC ..... F24F 7/007
USPC ..... 454/237
See application file for complete search history.

(56) References Cited

U.S. PATENT DOCUMENTS 5,024,263 A * 6/1991 Laine ..... F24F 12/006 165/283
5,193,610 A 3/1993 Morissette et al.
5,632,334 A 5/1997 Grinbergs et al.
2004/0134210 A1* 7/2004 Yabu ..... F28D 9/0081 62/271
2011/0146941 A1 6/2011 Benoit et al.

FOREIGN PATENT DOCUMENTS

CN 109237755 A 1/2019
EP 2053317 B1 3/2016
KR 20080001312 A * 1/2008 ..... F24F 12/001
WO 2019174217 A1 9/2019

OTHER PUBLICATIONS

Extended European Search Report received for EP Application No. 23200426.7, mailed on May 2, 2024, 9 Pages.

* cited by examiner

*Primary Examiner* — Avinash A Savani
*Assistant Examiner* — Dana K Tighe
(74) *Attorney, Agent, or Firm* — Andrew Goldberg

(57) ABSTRACT

A ventilator having a bypass ventilator core/blank core configured removably in a first chamber of a housing of the ventilator. Housing includes a first flowpath between a first inlet and a first outlet, and a second flowpath between a second inlet to a second outlet. The two flowpaths extend through the first chamber. The blank core includes at least one first passageway and at least one second passageway that are in fluid communication with the first flowpath and the second flowpath respectively, thereby allowing a first fluid to flow from the first inlet to the first outlet and a second fluid from the second inlet to the second outlet. Replacement of the blank core by one or more recovery cores enables conversion of the ventilator to a recovery ventilator.

20 Claims, 6 Drawing Sheets

BYPASS VENTILATOR CORE

CROSS-REFERENCE TO RELATED APPLICATION

This patent application claims the benefit of priority of U.S. Provisional Patent Application No. 63/377,404, filed on Sep. 28, 2022.

BACKGROUND

Exemplary embodiments pertain to the art of ventilators for supply of fresh air and exhausting stale air from enclosed spaces. More particularly, the present disclosure relates to a bypass ventilator core/blank core for ventilators that allows conversion of the ventilator to a recovery ventilator.

Energy Recovery Ventilators (ERVs) and Heat Recovery Ventilators (HRVs) typically are sold pre-configured with and ERV or HRV core installed. Typical ERVs and HRHs provide balanced ventilation, which requires same amount of stale air being exhausted out of the building as there is fresh air being pimped into the building, and energy or heat recovery. The preinstalled core makes the ERVs and HRVs expensive. As there are a number of homebuilders who cannot afford the cost of ERVs and HRVs upfront, but would prefer to have an option to upgrade in future, there is a need for an approach that enables conversion of a ventilator to a heat recovery ventilator or an energy recovery ventilator, or a combination thereof.

BRIEF DESCRIPTION

Disclosed herein is a ventilator comprising a housing having a first flowpath extending from a first inlet to a first outlet and a second flowpath extending from a second inlet to a second outlet. The housing includes a partition defining a first chamber therein. Each of the first flowpath and the second flowpath extends through the first chamber. The ventilator further includes a blank core configured to be removably fitted in the first chamber. The blank core includes at least one first passageway and at least one second passageway such that the at least one first passageway is in fluid communication with the first flowpath and the at least one second passageway is in fluid communication with the second flowpath, thereby allowing a first fluid to flow from the first inlet to the first outlet and a second fluid from the second inlet to the second outlet.

In accordance with additional or alternative embodiments, the blank core may be configured such that no substantial thermal interaction between the first fluid and the second fluid takes place as the first fluid and the second fluid flow through the at least one first passageway and the at least one second passageway.

In accordance with additional or alternative embodiments, the housing may be configured such that the first flowpath and the second flowpath intersect in the first chamber defining a cross flow or a cross-counter flow.

In accordance with additional or alternative embodiments, the first chamber may be configured to receive, after the blank core has been removed therefrom, one or more recovery cores configured to transfer any or a combination of water and thermal energy between the first fluid and the second fluid.

In accordance with additional or alternative embodiments, the ventilator may include a second chamber in the housing, and the first flowpath may extend through both the first chamber and the second chamber and the second flowpath may extend through the first chamber.

In accordance with additional or alternative embodiments, the ventilator may include a movable damper disposed in the first flowpath. The damper may be configured to apportion an amount of the first fluid flowing therein between the first chamber and the second chamber.

In accordance with additional or alternative embodiments, the movable damper may be configured to direct a substantial portion of the first fluid flowing therein along the first flowpath through the first chamber when in a first position and through the second chamber when in a second position.

In accordance with additional or alternative embodiments, the second chamber and the movable damper may be configured in a removable part. The removable part may be configured to be fitted in place of a cover part of the housing, which is devoid of the second chamber and the movable damper.

In accordance with additional or alternative embodiments, fitment of the removable part having the second chamber and the movable damper, and of the one or more recovery cores converts the ventilator to a heat recovery ventilator or an energy recovery ventilator.

In accordance with additional or alternative embodiments, the ventilator may include one or more fans disposed upstream or downstream of the first chamber for moving any or both of the first and second fluid through the housing along the respective flowpath.

In accordance with additional or alternative embodiments, the ventilator may include a first fan configured in the first flowpath and a second fan disposed in the second flowpath, disposed upstream or downstream of the first chamber. The first fan and the second fan may be configured to control flow of the first fluid and the second fluid to achieve a balanced ventilation.

Further disclosed herein is a blank core for a ventilator having at least one first passageway and at least one second passageway such that, when the blank core is fitted in a first chamber of a housing of the ventilator, the at least one first passageways is in fluid communication with a first flowpath from a first inlet to a first outlet of the ventilator, and the at least one second passageways is in fluid communication with a second flowpath from a second inlet to a second outlet of the ventilator, thereby allowing a first fluid to flow from the first inlet of the ventilator to the first outlet of the ventilator and a second fluid from the second inlet to the second outlet of the ventilator. The blank core is configured to be removably fitted in the first chamber of a housing of the ventilator, thereby enabling replacement of the blank core by one or more recovery cores configured to transfer any or a combination of water and thermal energy between the first fluid and the second fluid.

In accordance with additional or alternative embodiments, the blank core may be configured such that no substantial thermal interaction between the first fluid and the second fluid takes place as the first fluid and the second fluid flow through the at least one first passageway and the at least one second passageway.

In accordance with additional or alternative embodiments, the blank core may be configured such that the first fluid and the second fluid undergo a cross flow through the first passageway and the second passageway of the blank core.

In accordance with additional or alternative embodiments, the blank core may be configured such that the first fluid and the second fluid undergo a cross-counter flow through the first passageway and the second passageway of the blank core.

In accordance with additional or alternative embodiments, the blank core may be made of any or a combination of a metal, a plastic and a composite material.

In accordance with additional or alternative embodiments, the blank core may be made by any or a combination of fabrication process, injection moulding and 3-D printing.

Also disclosed herein is a method of converting a ventilator to a recovery ventilator. The method includes the steps of: providing the ventilator which includes: a housing having a first flowpath extending from a first inlet to a first outlet and a second flowpath extending from a second inlet to a second outlet, the housing further includes a partition defining a first chamber therein, and each of the first flowpath and the second flowpath extends through the first chamber; and a blank core configured to be removably fitted in the first chamber, and comprising at least one first passageway and at least one second passageway such that the at least one first passageways is in fluid communication with the first flowpath and the at least one second passageways is in fluid communication with the second flowpath, thereby allowing a first fluid to flow from the first inlet to the first outlet and a second fluid from the second inlet to the second outlet.

The method further includes the steps of removing the blank core; and fixing one or more recovery cores configured to transfer any or a combination of water and thermal energy between the first fluid and the second fluid.

In accordance with additional or alternative embodiments, the method may further include: replacing a cover part affixed to the housing by a removable part, which includes a second chamber and a movable damper. The second chamber may be configured such that the first flowpath extends through both the first chamber and the second chamber and the second flowpath extends through the first chamber. The movable damper may be configured to apportion an amount of the first fluid between the first chamber and the second chamber.

Technical effects of embodiments of the present disclosure include ability to provide an entry level low cost ventilator that can be upgraded, if required, to a recovery ventilator at a later date. Further, the disclosed blank core can also be used as a useful accessory replacing the recovery cores during seasons that do not require heat/energy recovery, thereby saving energy on account of lower resistance to airflow offered by the blank core as compared to the heat/energy recovery cores.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
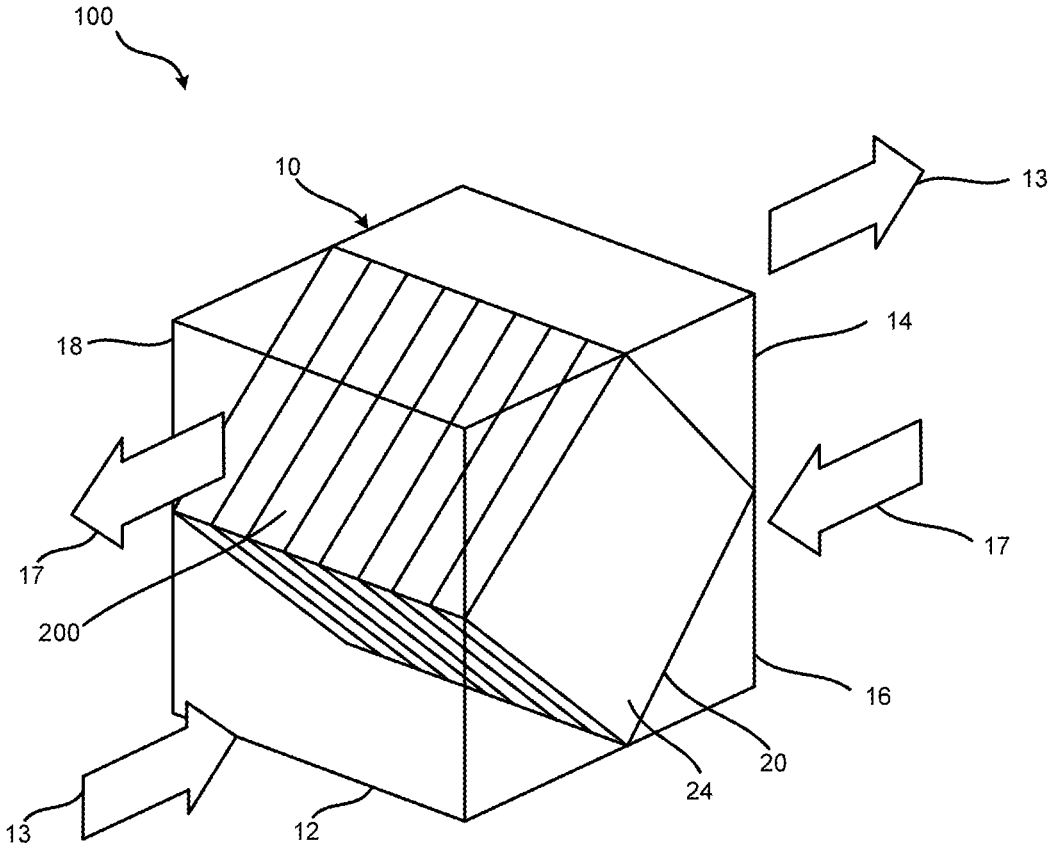
FIG. 1 is a schematic illustration of an exemplary ventilator having two flowpaths crossing in a first chamber having a blank core, in accordance with one or more embodiments of the disclosure.

FIG. 1 is a schematic illustration of a ventilator 100. The ventilator can include a housing 10 having a first flowpath 13 therethrough, extending from a first inlet 12 to a first outlet 14, and a second flowpath 17 therethrough, extending from a second inlet 16 to a second outlet 18. The first inlet 12 and the first outlet 14 can be disposed on opposite sides of the housing 10 and the second inlet 16 and the second outlet 18 can be disposed on opposite sides of the housing 10. The ventilator 100 can be configured to ventilate a space (e.g., within a building). For example, the first flowpath 13 can include fresh outdoor air being brought into a space within the building as ventilation air and the second flowpath 17 can include stale indoor air being exhausted from the space within the building, or vice versa (e.g., where the second flowpath 17 represents the fresh outdoor air and the first flowpath 13 represents stale indoor air to be exhausted). The housing 10 can include a partition 20 defining a first chamber 24. The ventilator 100 can be configured such that the first flowpath 13 and the second flowpath 17 intersect each other in the first chamber 24.

The housing 10 of the ventilator 100 can be made from any suitable materials. For example, the housing 10 can be formed from one or more disparate materials, such as metals (e.g., aluminum, galvanized steel, and the like), plastics (e.g., polymers such as polyethylene, polycarbonate, polypropylene, polystyrene, polyvinyl chloride, acrylonitrile butadiene styrene (ABS), and the like), composite materials (e.g., polymer resin and one or more fillers, such as for example, epoxy and fiberglass), or natural materials such as wood, or the like. The housing 10 and partition 20 can be formed together, such as in a casting or molding process, or can be formed separately and assembled, such as in a sheet metal forming and assembling process.

The ventilator 100 can optionally include one or more fans (not shown here) for moving fluid through the housing 10 along the first flowpath 13 and/or along the second flowpath 17. Further, the one or more fans can be disposed upstream or downstream of the first chamber 24 and can be controlled independently or in concert. The fans can be controlled, such as by a controller, to ensure a balanced ventilation, i.e., same amount of stale air being exhausted out of the building as there is fresh air being pumped in.

In an aspect, the ventilator 100 can include a removable blank core that can be replaced by one or more recovery cores to upgrade the ventilator 100 to a recovery ventilator, if required. In certain applications, the blank core can be an accessory to be fitted replacing the one or more recovery cores of a recovery ventilator, when there is no requirement of heat recovery.

Figure 2A:
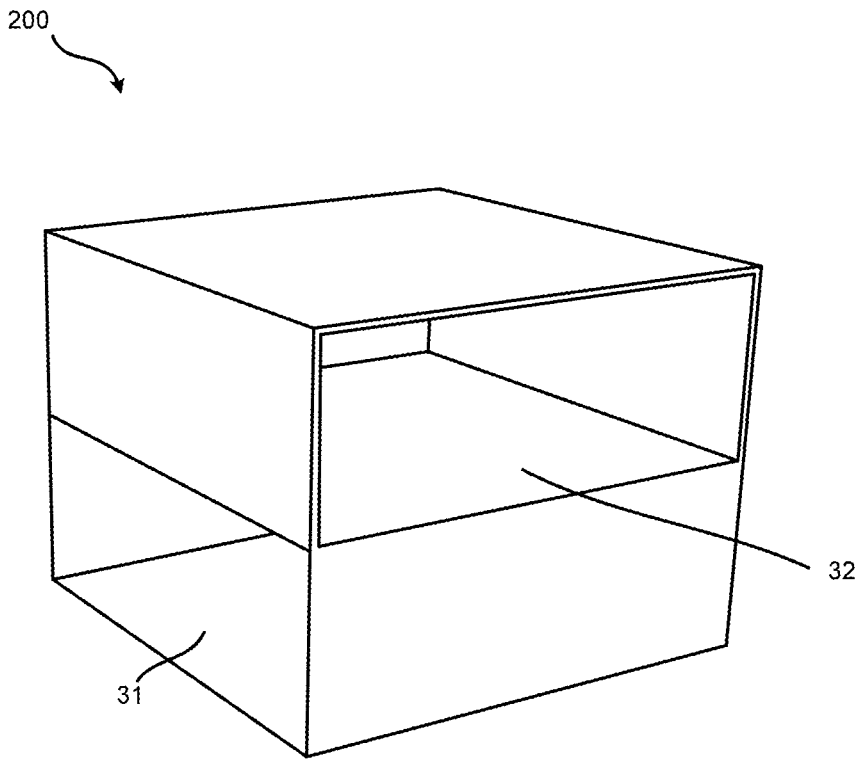
FIG. 2A is a schematic illustration of an exemplary blank core having a single set of first passageway and the second passageway, in accordance with one or more embodiments of the disclosure.
Figure 2B:
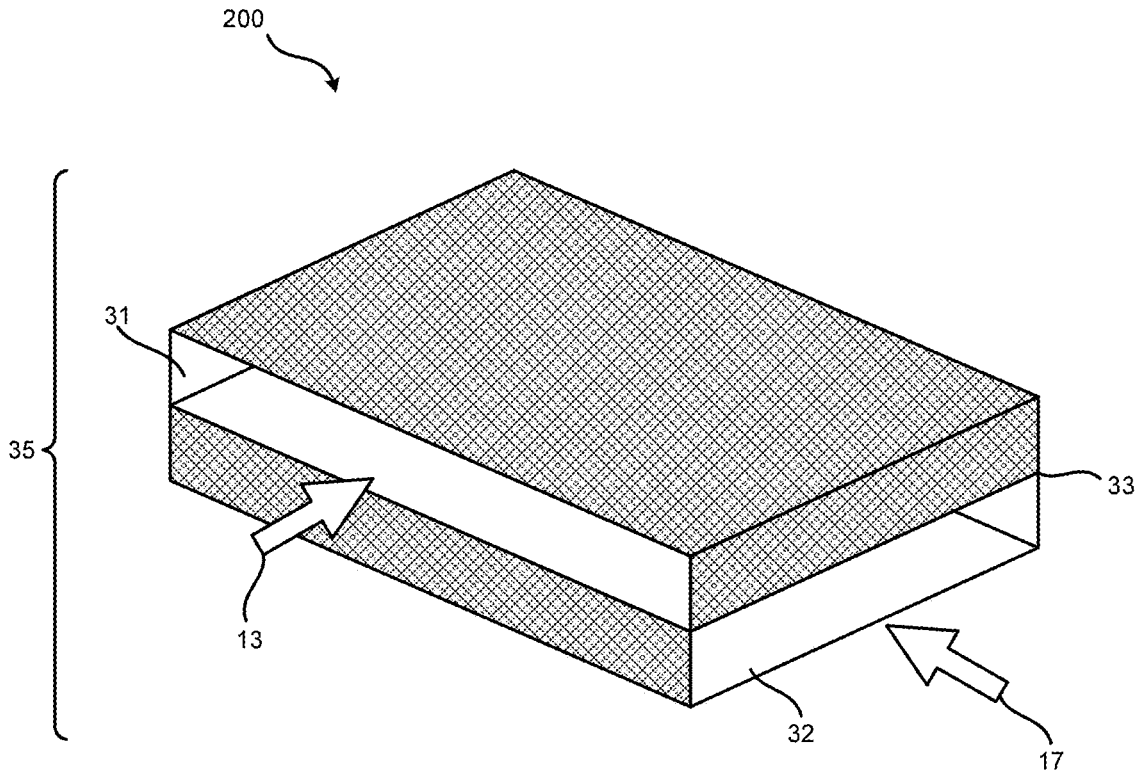
FIG. 2B is a schematic illustration of an exemplary blank core having a plurality of first passageways and the second passageways, in accordance with one or more embodiments of the disclosure.

The blank core, such as blank core 200 shown in FIGS. 2A and 2B, can be configured for removable fitment in the first chamber 24 of the housing 10 of the ventilator 100. The blank core 200 can have at least one first passageway 31 therethrough for passing, when fitted in the first chamber 24, the first fluid along the first flowpath 13 and a second passageway 32 therethrough for passage of the second fluid along the second flowpath 17, while allowing no mass transfer between the two fluids, as the two fluid pass through the first passageway 31 and the second passageway 32. The blank core 200 can be disposed in the first chamber 24 of the ventilator 100 such that the one or more first passageway 31 are in fluid communication with the first flowpath 13 and the one or more second passageway 32 is in fluid with the second flowpath 17.

In different embodiments, the blank core 200 can include only one set of the first passageway 31 and the second passageway 32, as shown in FIG. 2A, or it can have a plurality of first passageways 31 and the second passageways 32 positioned alternately over one other, forming a stack 35, as shown in FIG. 2B, having multiple layers of adjacent flow passageways 31 and 32.

One first passageway 31 and one second passageway 32 of the blank core 200 of FIG. 2A can be formed from adjacent channels (e.g., from U-shaped plates or stacked open-ended boxes) such that the first passageway 31 and the second passageway 32 are disposed in perpendicular relation to one another. An optional separator 33 can include thermal insulation material to prevent heat transfer between the two crossing fluids. In this case the dimensions of each passageway 31, 32 through the blank core 200 can be up to approximately half the size of the first chamber 24 into which the blank core 200 is placed.

The blank core 200 can be configured for minimizing thermal transfer between the adjacent fluids. The size (e.g., cross-sectional flow area, which may be viewed as the open space available for fluid to flow through along a given passageway of the core) of the one or more first and second passageways 31, 32 of the blank core 200 can be increased relative to a corresponding recovery core because heat and/or mass transfer between the crossing fluids is not an object of the blank core. The blank core 200 can be configured to minimize interfacial surface area between the crossing fluids to aid in achieving adiabatic operation. Enlarging the passageways of the blank core 200, in comparison to recovery cores, can reduce the pressure drop therethrough. The reduced pressure drop can result in reduced power requirement for the fans for moving the first fluid and the second fluid through the housing 10 along the first flowpath 13 and the second flowpath 17, respectively.

Further, because there is no heat or mass transfer between adjacent fluids traversing the blank core the blank core 200 need not be made of expensive thermally conductive materials, thereby reducing cost of the ventilator 100. The blank core 200 can be made of any or a combination of materials, such as but not limited to, a metal, a plastic and composite materials. It can be made by any or a combination of processes, such as but not limited to, fabrication, injection moulding, and 3-D printing. The blank core 200 can be of one-piece construction, or can be made of a number of parts assembled together to form the blank core 200.

In accordance with an embodiment, the blank core 200 can be configured such that it can be folded or dismantled into a flat configuration for ease of transportation and storage, when used as an accessory.

In accordance with an embodiment, the first inlet 12, the first outlet 14, the second inlet 16 and the second outlet 18 are configured in the housing 10 such that the first flowpath 13 and the second flowpath 17 intersect each other at the first chamber 24. Accordingly, the first fluid and the second fluid undergo a cross flow in the blank core 200 fitted in the first chamber 24, through the respective passageways 31 and 32 which are oriented orthogonal to each other, as shown in FIGS. 2A and 2B. In an alternate embodiment, it is possible to configure the blank core 200 such that the first fluid and the second fluid undergo a combination of counter and counter flow (referred to as cross-counter flow) in the blank core 200.

Figure 3:
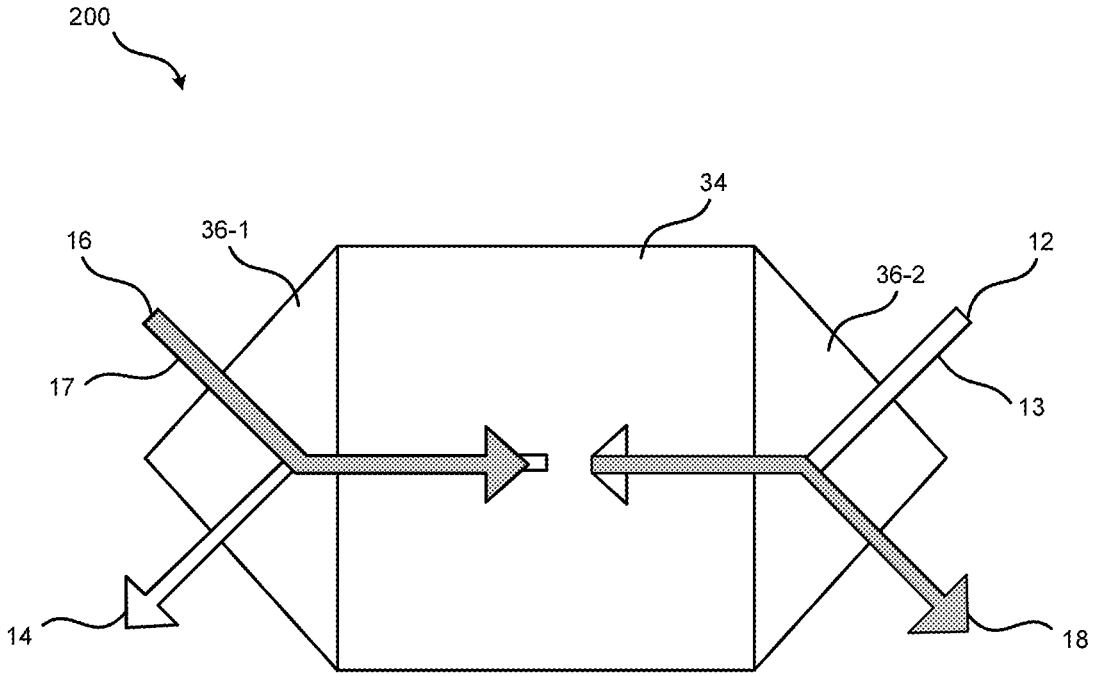
FIG. 3 is a schematic illustration of a blank core having cross-counter flow of a first and second fluid along a first and second flow path, in accordance with one or more embodiments of the disclosure.

FIG. 3 is a schematic diagram showing flow of the first fluid and the second fluid in a blank core 200 that is configured for cross-counter flow, wherein the first fluid and the second fluid undergo a counter flow in a middle portion 34 of the blank core, and cross flow in two end portions 36-1 and 36-2 of the blank core. Accordingly, the recovery core that replaces the blank core can also be similarly configured for cross-counter flow.

Figure 4:
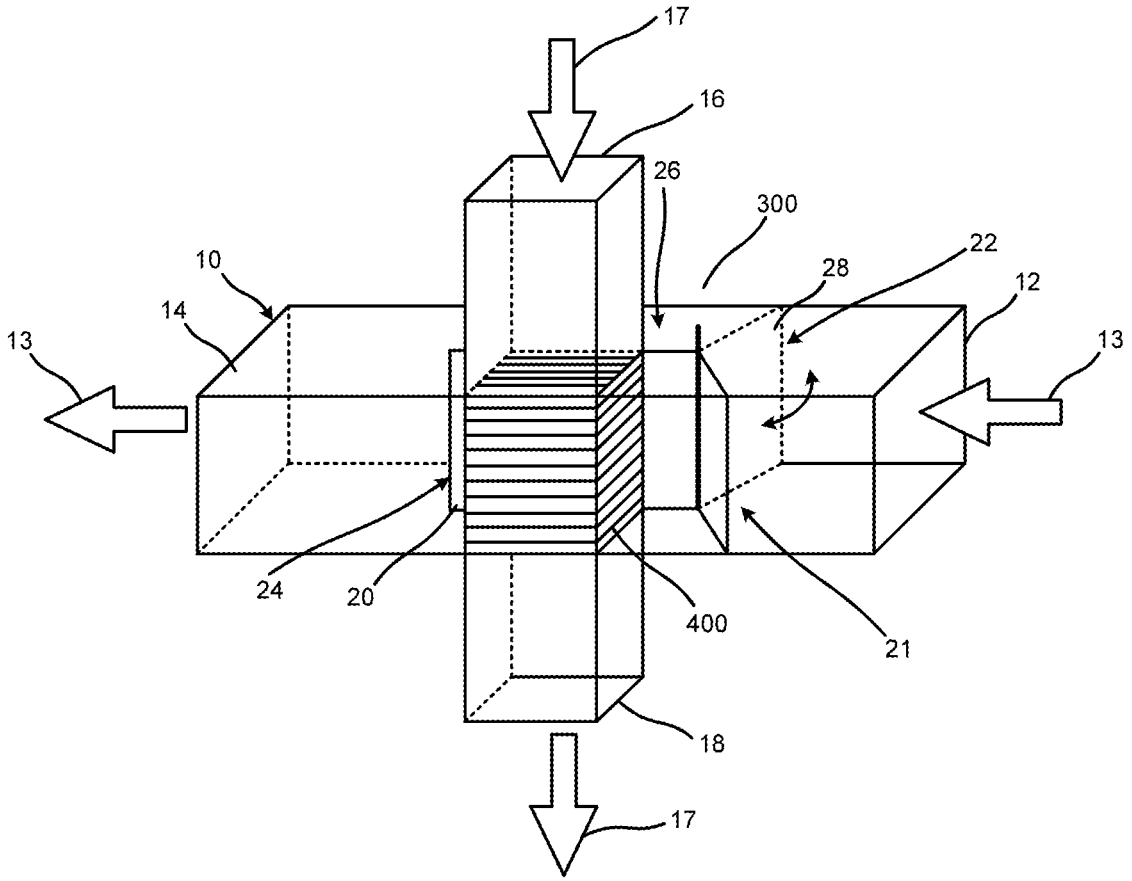
FIG. 4 is a schematic illustration of an exemplary ventilator with a recovery core replacing the blank core with bypass functionality through a moving damper, in accordance with one or more embodiments of the disclosure.

FIG. 4 shows a recovery core 400 fitted in the first chamber 24 replacing the blank core 200. The recovery core 400 can be fitted in the first chamber 24 such that the first flow path and the second flow path pass through the recovery core 400 for transfer of any or a combination of heat, energy and moisture between the first fluid and the second fluid, thereby upgrading the ventilator 100 to a recovery ventilator.

In an embodiment, the ventilator may include a second chamber 26 in the housing 10. The first flowpath 13 may extend through both the first chamber 24 and the second chamber 26, and the second flowpath 17 may extend through the first chamber 24. In application, the second chamber can function as a bypass path for first fluid flowing through the first flow path to bypass the recovery core 400. The ventilator can also include a movable damper 28 disposed in the first flowpath 13. The damper 28 may be configured to apportion an amount of the first fluid flowing therein between the first chamber 24 and the second chamber 26, thereby controlling the amount of the first fluid that bypasses the recovery core 400. For example, the damper 28 can move between a first position 22 and a second position 21. In the first position 22, the damper 28 can direct a substantial portion of the first fluid flowing therein through the first chamber 24, i.e. the recovery core 400, and in the second position 21, the damper 28 can direct a substantial portion of the first fluid through the second chamber 26.

In accordance with additional or alternative embodiments, the second chamber and the movable damper may be configured in a removable part 300. The removable part 300 may be configured to be fitted in place of a cover part (not shown here) of the housing 10, which is devoid of the second chamber 26 and the movable damper 28.

It is to be understood that while the exemplary embodiment of the second chamber and the damper has been explained with reference to a single second chamber and a single damper configure on a removable part, it is possible to configure the ventilator 100 for two second chambers and two dampers configured on two removable parts, each set of second chamber and the corresponding damper configured with different flowpath 13 and 17 to control flow of the first fluid and the second fluid through the recovery core 400.

Thus, fitment of the removable part 300 having the second chamber 26 and the movable damper 28, and of one or more recovery cores 400 converts the ventilator 100 to a recovery ventilator.

Figure 5:
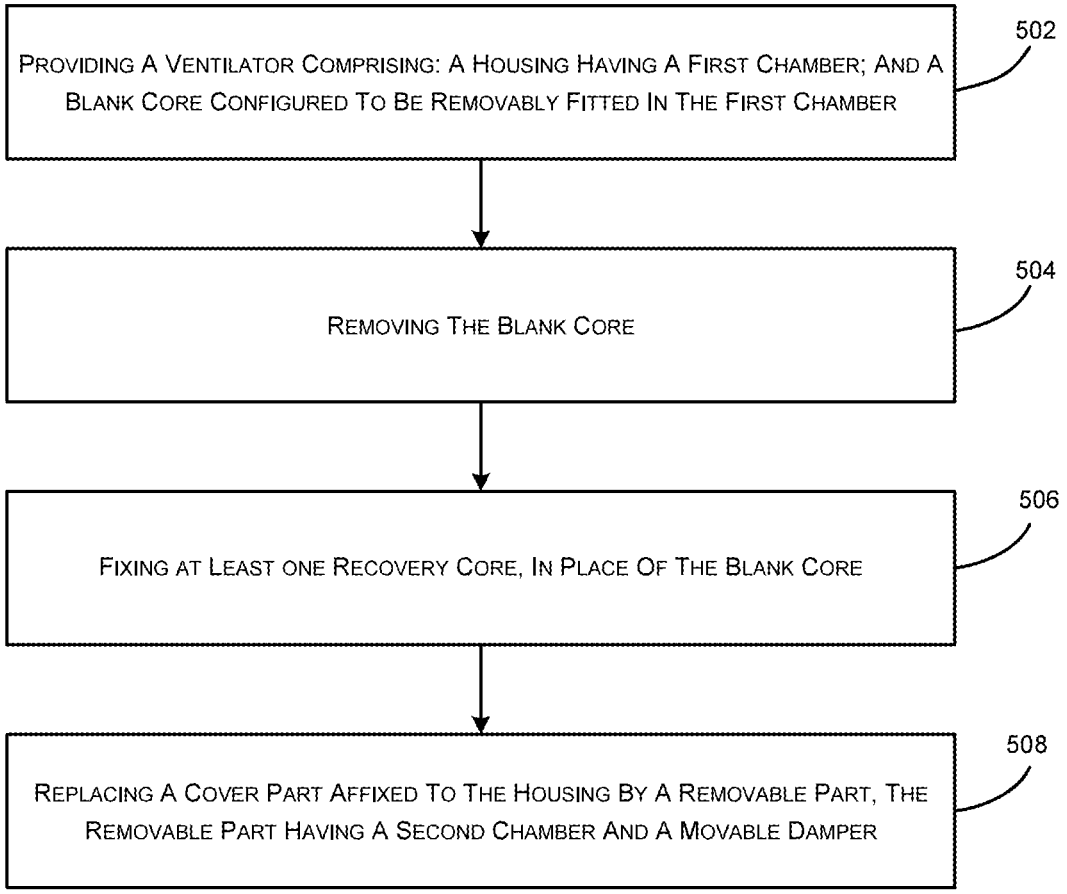
FIG. 5 is an exemplary method flow diagram for a method of converting a ventilator to a heat/energy ventilator, in accordance with one or more embodiments of the disclosure.

FIG. 5 is a method flow diagram for a method of converting a ventilator to a heat/energy recovery ventilator or an energy recovery ventilator. The method can at step 502 include providing the ventilator, such as ventilator 100 shown in FIG. 1. The ventilator 100 can include: a housing 10 having a first flowpath 13 extending from a first inlet 12 to a first outlet 14 and a second flowpath 17 extending from a second inlet 16 to a second outlet 18. The housing 10 further includes a partition 20 defining a first chamber 24 therein. Each of the first flowpath 13 and the second flowpath 17 can extend through the first chamber 24. The ventilator 100 also includes a blank core, such as the blank core 200 shown in FIGS. 2A and 2B, configured to be removably fitted in the first chamber 24, and comprising at least one first passageway 31 and at least one second passageway 32 such that the at least one first passageways 31 is in fluid communication with the first flowpath 13 and the at least one second passageways 32 is in fluid communication with the second flowpath 17, thereby allowing a first fluid to flow from the first inlet 12 to the first outlet 14 and a second fluid from the second inlet 16 to the second outlet 18.

The method can further include step 504 of: removing the blank core 200, and step 506 of; fixing a recovery core, such as recovery core 400 shown in FIG. 4, configured to transfer any or a combination of water and thermal energy between the first fluid and the second fluid.

The method can further include step 508 of: replacing a cover part affixed to the housing 10 by a removable part, such as removable part 300 shown in FIG. 4, which includes a second chamber 26 and a movable damper 28. The second chamber 26 can be configured such that the first flowpath 13 extends through both the first chamber 24 and the second chamber 26 and the second flowpath 17 extends through the first chamber 24. The movable damper 28 can be configured to apportion an amount of the first fluid between the first chamber 24 and the second chamber 26.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A ventilator comprising:

a housing comprising a first flowpath extending from a first inlet to a first outlet and a second flowpath extending from a second inlet to a second outlet, wherein the housing comprises a partition defining a first chamber therein, and wherein each of the first flowpath and the second flowpath extends through the first chamber; and a blank core configured to be removably fitted in the first chamber, and comprising at least one first passageway and at least one second passageway such that the at least one first passageway is in fluid communication with the first flowpath and the at least one second passageway is in fluid communication with the second flowpath, thereby allowing a first fluid to flow from the first inlet to the first outlet and a second fluid from the second inlet to the second outlet, wherein the blank core is configured to minimize thermal transfer between the first fluid and the second fluid by minimizing interfacial surface area between the at least one first passageway and the at least one second passageway.

2. The ventilator of claim 1, wherein wherein the at least one first passageway and the at least one second passageway have a cross-sectional flow area increased relative to a thermal or energy recovery core to reduce pressure drop through the blank core.

3. The ventilator of claim 1, wherein the housing is configured such that the first flowpath and the second flowpath intersect in the first chamber.

4. The ventilator of claim 1, wherein the blank core is configured such that the first fluid and the second fluid undergo a cross-flow through the blank core, and wherein the blank core comprises a thermally insulative separator disposed between the at least one first passageway and the at least one second passageway.

5. The ventilator of claim 1, wherein the blank core is configured such that the first fluid and the second fluid undergo a cross-counter flow through the blank core.

6. The ventilator of claim 1, wherein the first chamber is configured to receive, after the blank core has been removed therefrom, a first recovery core configured to transfer water and thermal energy between the first fluid and the second fluid, or a second recovery core configured to transfer thermal energy between the first fluid and the second fluid, or a combination thereof.

7. The ventilator of claim 6, wherein the ventilator comprises a second chamber in the housing, and wherein the first flowpath extends through both the first chamber and the second chamber and the second flowpath extends through the first chamber.

8. The ventilator of claim 7, wherein the ventilator comprises a movable damper disposed in the first flowpath and configured to apportion an amount of the first fluid flowing therein between the first chamber and the second chamber.

9. The ventilator of claim 8, wherein the movable damper is configured to direct a substantial portion of the first fluid flowing therein along the first flowpath through the first chamber when in a first position and through the second chamber when in a second position.

10. The ventilator of claim 8, wherein the second chamber and the movable damper are configured in a removable part, which removable part is configured to be fitted in place of a cover part of the housing, which cover part does not comprise the second chamber and the movable damper.

11. The ventilator of claim 10, wherein fitment of the removable part comprising the second chamber and the movable damper, and of the first recovery core, or a second recovery core, or a combination thereof converts the ventilator to a heat recovery ventilator or an energy recovery ventilator.

12. The ventilator of claim 1, wherein the ventilator comprises one or more fans disposed upstream or downstream of the first chamber for moving any or both of the first and second fluid through the housing along the respective flowpath.

13. The ventilator of claim 1, wherein the ventilator comprises a first fan configured in the first flowpath and a second fan disposed in the second flowpath, disposed upstream or downstream of the first chamber; the first fan and the second fan being configured to control flow of the first fluid and the second fluid to achieve a balanced ventilation.

14. A blank core for a ventilator comprising at least one first passageway and at least one second passageway such that, when the blank core is fitted in a first chamber of a housing of the ventilator, the at least one first passageways is in fluid communication with a first flowpath from a first inlet to a first outlet of the ventilator, and the at least one second passageways is in fluid communication with a second flowpath from a second inlet to a second outlet of the ventilator, thereby allowing a first fluid to flow from the first inlet of the ventilator to the first outlet of the ventilator and a second fluid from the second inlet to the second outlet of the ventilator;

wherein the blank core is configured to be removably fitted in the first chamber of the housing of the ventilator, thereby enabling replacement of the blank core by one or more recovery cores configured to transfer any or a combination of water and thermal energy between the first fluid and the second fluid, and wherein the blank core is configured to minimize thermal transfer between the first fluid and the second fluid by minimizing interfacial surface area between the at least one first passageway and the at least one second passageway.

15. The blank core of claim 14, wherein the at least one first passageway and the at least one second passageway have a cross-sectional flow area increased relative to a thermal or energy recovery core to reduce pressure drop through the blank core.

16. The blank core of claim 14, wherein the blank core is configured such that the first fluid and the second fluid undergo a cross flow therethrough, and wherein the blank core comprises a thermally insulative separator disposed between the at least one first passageway and the at least one second passageway.

17. The blank core of claim 14, wherein the blank core is configured such that the first fluid and the second fluid undergo a cross-counter flow therethrough.

18. The blank core of claim 14, wherein the blank core is made of any or a combination of a metal, a plastic and a composite material.

19. A method of converting a ventilator to a recovery ventilator, comprising:

providing the ventilator comprising:

a housing comprising a first flowpath extending from a first inlet to a first outlet and a second flowpath extending from a second inlet to a second outlet, wherein the housing comprises a partition defining a first chamber therein, and wherein each of the first flowpath and the second flowpath extends through the first chamber; and a blank core configured to be removably fitted in the first chamber, and comprising at least one first passageway and at least one second passageway such that the at least one first passageway is in fluid communication with the first flowpath and the at least one second passageway is in fluid communication with the second flowpath, thereby allowing a first fluid to flow from the first inlet to the first outlet and a second fluid from the second inlet to the second outlet, wherein the blank core is configured to minimize thermal transfer between the first fluid and the second fluid by minimizing interfacial surface area between the at least one first passageway and the at least one second passageway;

removing the blank core;

fixing one or more recovery cores configured to transfer any or a combination of water and thermal energy between the first fluid and the second fluid; and replacing the blank core.

20. The method of claim 19, further comprising: replacing a cover part affixed to the housing by a removable part, which removable part comprises a second chamber and a movable damper, the second chamber being configured such that the first flowpath extends through both the first chamber and the second chamber and the second flowpath extends through the first chamber, and wherein the movable damper is configured to apportion an amount of the first fluid between the first chamber and the second chamber.

* * * * *